US012402736B2

(12) United States Patent
Roberts

(10) Patent No.: US 12,402,736 B2
(45) Date of Patent: Sep. 2, 2025

(54) STABILIZATION PILLOWS

(71) Applicant: Eric Clifton Roberts, Tyler, TX (US)

(72) Inventor: Eric Clifton Roberts, Tyler, TX (US)

( * ) Notice: Subject to any disclaimer, the term of this patent is extended or adjusted under 35 U.S.C. 154(b) by 609 days.

(21) Appl. No.: 17/699,143

(22) Filed: Mar. 20, 2022

(65) Prior Publication Data

US 2023/0292942 A1 Sep. 21, 2023

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC . A47G 9/10; A47G 9/1081; A47G 2009/1018
See application file for complete search history.

(56) References Cited

U.S. PATENT DOCUMENTS 414,748 A * 11/1889 Bentley ..... A47G 9/10 5/636
2,522,120 A * 9/1950 Kaskey ..... A47G 9/10 5/636
2,700,779 A * 2/1955 Tolkowsky ..... A47G 9/10 5/636
2,940,087 A * 6/1960 Kiefer ..... A47G 9/10 5/636
3,239,854 A * 3/1966 Freelander ..... A47G 9/10 5/636
3,757,365 A * 9/1973 Kretchmer ..... A47G 9/10 5/636
4,349,925 A * 9/1982 Macomber ..... A47G 9/10 5/636
4,550,458 A * 11/1985 Fiore ..... A47G 9/109 5/640
4,821,355 A * 4/1989 Burkhardt ..... A47G 9/10 5/636
5,070,865 A * 12/1991 Lams ..... A47G 9/1009 606/240
5,138,732 A * 8/1992 Wattie ..... A47G 9/10 5/636
5,163,194 A * 11/1992 Dixon ..... A47G 9/1081 5/639
5,226,188 A * 7/1993 Liou ..... A47C 7/742 5/653
5,360,017 A * 11/1994 Austin ..... A61F 5/01 5/640
5,727,267 A * 3/1998 Keilhauer ..... A47G 9/109 5/636
6,484,336 B1 * 11/2002 Berke ..... A47G 9/10 5/636

(Continued)

FOREIGN PATENT DOCUMENTS

KR 20210061602 A * 5/2021

*Primary Examiner* — Eric J Kurilla
(74) *Attorney, Agent, or Firm* — Chong IP Law Group

(57) ABSTRACT

Stabilization pillows for offsetting mattress deformation caused by a user's weight in accordance with embodiments of the invention are disclosed. In one embodiment, a stabilization pillow includes a top surface and a bottom surface, and a bottom padding portion, where the bottom padding portion protrudes relative to the bottom surface to offset mattress deformation caused by a user's weight on a mattress.

13 Claims, 11 Drawing Sheets

(56) References Cited

U.S. PATENT DOCUMENTS 7,469,435 B1 * 12/2008 Cullifer ..... A47G 9/10 5/636
8,316,855 B2 * 11/2012 Lee ..... A61H 7/001 606/240
8,910,330 B1 * 12/2014 Malik ..... A47G 9/109 5/636
12,035,833 B1 * 7/2024 Baek ..... A47G 9/1081
2004/0107501 A1 * 6/2004 Kancilja ..... A47G 9/10 5/636
2005/0138733 A1 * 6/2005 Riesberg ..... A47G 9/10 5/636
2007/0118991 A1 * 5/2007 Nakayama ..... A47G 9/109 5/636
2011/0061167 A1 * 3/2011 Farley ..... A47G 9/10 83/13
2012/0073056 A1 * 3/2012 Freund ..... A47G 9/10 5/639
2013/0191998 A1 * 8/2013 Wootten, Jr. ..... A47G 9/10 5/636
2013/0283534 A1 * 10/2013 Marinkovic ..... A47G 9/109 5/636
2015/0047646 A1 * 2/2015 Marinkovic ..... A61H 1/008 606/240
2017/0128307 A1 * 5/2017 Kim ..... A61F 5/04
2017/0216118 A1 8/2017 Davis et al.
2018/0055252 A1 * 3/2018 Jensen ..... A47G 9/1081
2018/0140116 A1 * 5/2018 Werner ..... A47G 9/0253
2018/0310732 A1 11/2018 Loos
2019/0231099 A1 * 8/2019 Davis ..... A61G 7/0755
2019/0274908 A1 9/2019 Marinkovic
2020/0154912 A1 * 5/2020 Del Balso ..... A47G 9/10
2020/0155395 A1 * 5/2020 Popitz ..... A61G 7/072
2022/0022669 A1 * 1/2022 Castaldo ..... A47G 9/1009
2022/0265464 A1 * 8/2022 Baek ..... A61F 5/56
2023/0210282 A1 * 7/2023 Lee ..... A47G 9/1009 5/643
2024/0023734 A1 * 1/2024 Kitson ..... A47G 9/1081
2024/0065460 A1 * 2/2024 Berke ..... A47G 9/10

* cited by examiner

STABILIZATION PILLOWS

FIELD OF THE INVENTION

The present disclosure generally relates to pillows and more specifically to stabilization pillows configured to provide support and balance for the physical characteristics of a user and the surrounding environment such as, but not limited to, a bed mattress.

BACKGROUND

A pillow typically refers to a cushion that provides support to a user at rest. Some types of pillows may include bed pillows, throw pillows, body pillows, decorative pillows, and others. Generally, pillows may include a fabric envelope (e.g., a pillowcase) which may contain a soft stuffing (e.g., cotton, feathers, foam rubber, or other soft materials) to provide support to a resting user. For example, pillows may be used to aid in sleeping by providing support to the user's head and neck areas.

SUMMARY OF THE INVENTION

The various embodiments of the present stabilization pillows have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide the advantages described herein.

One aspect of the present embodiments includes the realization that current advances in conventional pillows still have not created a perfect pillow. As further described below, stabilization pillows provide engineered solutions to overlooked issues with conventional pillows. For example, conventional pillows tend to flatten out and are often too soft for proper support. Further, conventional pillows have fill that moves around and does not create consistent form for comfort. Moreover, conventional pillows hold heat. For example, even cooling technology pillows typically only utilize materials (e.g., gels) with a high heat capacity that eventually warm and hold the heat rather than dissipate it. Furthermore, conventional pillows are not adjustable for various physical characteristics of the user (e.g., dimensions, weight, etc.) and/or the surrounding environment (e.g., mattress). Further, conventional pillows tend to bunch up, slide, push to the headboard. In addition, with conventional pillows, the weight of the user's body (in particular around the shoulder area) sinks into the surrounding environment (e.g., a mattress) creating a moment through the neck that causes pain and issues as the neck and/or spine are not properly aligned. Further, the weight of the user's head generally rests with highest pressure at the center of the head, which causes muscles and tendons in the neck to be forced to balance the side to side position rather than simply rest in place. The above issues contribute to neck pain, longer periods trying to fall asleep and stay asleep, sweating, discomfort, breathing issues, health issues, hygienic issues, etc.

In a first aspect, a stabilization pillow is provided, the stabilization pillow comprising: a top surface and a bottom surface; and a bottom padding portion, where the bottom padding portion protrudes relative to the bottom surface to offset mattress deformation caused by a user's weight on a mattress.

In an embodiment of the first aspect, the stabilization pillow is constructed using memory foam.

In another embodiment of the first aspect, the bottom padding portion comprises a base and a peak.

In another embodiment of the first aspect, the bottom padding portion comprises a declining slope from the peak to the base.

In another embodiment of the first aspect, the bottom padding portion further comprises a first side and a second side, wherein the first and second sides are opposite.

In another embodiment of the first aspect, the base extends between the first side and the second side of the bottom padding portion.

In another embodiment of the first aspect, the peak extends between the first side and the second side of the bottom padding portion.

In another embodiment of the first aspect, the bottom padding portion further comprises a third side and a fourth side, wherein the third and fourth sides are opposite.

In another embodiment of the first aspect, the base rotates around a center point of the fourth side.

In another embodiment of the first aspect, the peak rotates around the center point of the fourth side.

In another embodiment of the first aspect, the base is located further from the center point of the fourth side than the peak.

In another embodiment of the first aspect, the stabilization pillow further comprises a head support portion to provide lateral head support.

In another embodiment of the first aspect, the head support portion is recessed relative to the top surface.

In another embodiment of the first aspect, the head support portion is a channel having a center section contour.

In another embodiment of the first aspect, the center section contour is narrower than a circumference of a user's head.

In another embodiment of the first aspect, the head support portion creates larger deformations further away from a center of a user's head creating lateral stability.

In another embodiment of the first aspect, the head support portion cradles a user's head to offset rotational imbalance.

In another embodiment of the first aspect, where a main portion of the stabilization pillow is made using a first material having a first spring constant and the head support portion is made using a second material having a second spring constant.

In another embodiment of the first aspect, the second spring constant is lower than the first spring constant.

In another embodiment of the first aspect, the stabilization pillow further comprises a neck support portion, wherein the neck support portion protrudes relative to the top surface.

In another embodiment of the first aspect, the stabilization pillow further comprising a shoulder channel, wherein the shoulder channel provides a space for a user's shoulder.

In another embodiment of the first aspect, the stabilization pillow further comprises at least one first air channel that extends between the top surface through a portion of the pillow up to and including completely through the bottom surface.

In another embodiment of the first aspect, the stabilization pillow further comprising at least one second air channel that extends perpendicular to the top surface and the bottom surface.

In another embodiment of the first aspect, the at least one first air channel and the at least one second air channel intersect.

In a second aspect, a pillow case for a stabilization pillow is provided, the pillow case comprising: integrally woven thermally conductive fibers for dissipating heat from a user's head; and wherein the stabilization pillow comprises a top surface, a bottom surface, and a bottom padding portion, wherein the bottom padding portion protrudes relative to the bottom surface to offset mattress deformation caused by the user's weight on a mattress.

BRIEF DESCRIPTION OF THE DRAWINGS

The various embodiments of the present stabilization pillows now will be discussed in detail with an emphasis on highlighting the advantageous features. These embodiments depict the novel and non-obvious stabilization pillows shown in the accompanying drawings, which are for illustrative purposes only. These drawings include the following figures.

DETAILED DESCRIPTION OF THE DRAWINGS

Figure 1A:
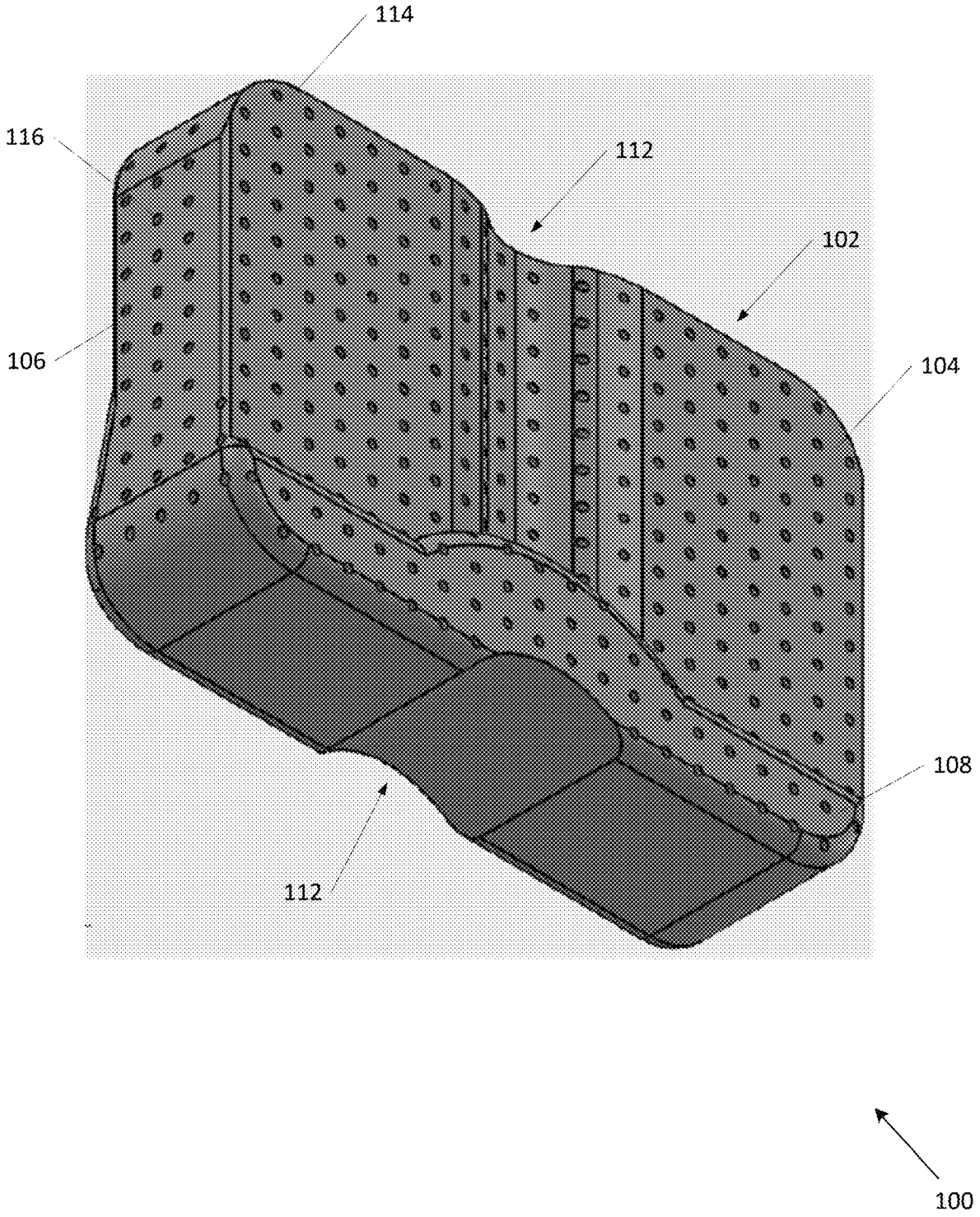
FIG. 1A is a top perspective view of a stabilization pillow in accordance with an embodiment of the invention.

The various embodiments of the present stabilization pillows contain several features, no single one of which is solely responsible for their desirable attributes. Without limiting the scope of the present embodiments, their more prominent features will now be discussed below. In particular, the present stabilization pillows will be discussed in the context of bed pillows utilized on mattresses. However, the use of bed pillows on mattresses are merely exemplary as stabilization pillows may be utilized for various environments as appropriate to the requirements of a specific application in accordance with embodiments of the invention. Further, the particular use of stabilization pillows for sleeping is also exemplary, and various other suitable uses of stabilization pillows may be appropriate to the requirements of a specific application in accordance with various embodiments of the invention. For example, stabilization pillows may be utilized for resting while awake, relaxing, etc. After considering this discussion, and particularly after reading the section entitled "Detailed Description," one will understand how the features of the present embodiments provide the advantages described here.

The following detailed description describes the present embodiments with reference to the drawings. In the drawings, reference numbers label elements of the present embodiments. These reference numbers are reproduced below in connection with the discussion of the corresponding drawing features. These figures, and their written descriptions, indicate that certain components of the apparatus are formed integrally, and certain other components are formed as separate pieces. Those of ordinary skill in the art will appreciate that components shown and described herein as being formed integrally may in alternative embodiments be formed as separate pieces. Those of ordinary skill in the art will further appreciate that components shown and described herein as being formed as separate pieces may in alternative embodiments be formed integrally. Further, as used herein the term integral describes a single unitary piece.

Turning now to the drawings, stabilization pillows in accordance with embodiments of the invention are disclosed. In many embodiments, stabilization pillows may include a top surface that interfaces with a user's body (e.g., a user's head) and a bottom surface that interfaces with a surrounding environment (e.g., a mattress). In various embodiments, stabilization pillows may include a bottom padding portion that may protrude relative to the bottom surface to offset mattress deformation caused by the user's weight on the mattress. For example, when a user lays down on the mattress and places their head on a stabilization pillow, the weight of the user's upper body (e.g., shoulder, neck, head) may depress the mattress causing mattress deformation. As further described below, the bottom padding portion of the stabilization pillow may be configured to offset such mattress deformations. In several embodiments, stabilization pillows may also include a head support portion to provide lateral head support, as further described below. In a variety of embodiments, stabilization pillows may also include a neck support portion that protrudes relative to the top surface of the stabilization pillow to provide support for a user's neck. In many embodiments, stabilization pillows may also include one or more shoulder channels to provide space and/or support for a user's shoulder(s). In particular, a shoulder channel may provide space for a user's shoulder when the user is lying on their side. Moreover, stabilization pillows may also include one or more air channels to provide cooling mechanisms, as further described below. Stabilization pillows in accordance with embodiments of the invention are further discussed below.

Stabilization Pillows

Stabilization pillows provide balanced and adjustable support that may compensate for the user's physique and the user's surrounding environment such as, but not limited to, level of firmness of a mattress. As further described below, stabilization pillows stay in place, actively cool, and provide constant and comfortable support that does not slide or lose its shape. Further, stabilization pillows provide support and balance for the unique ergonomic contours of the user and the mattress for side and back sleepers.

A top perspective view of a stabilization pillow in accordance with an embodiment of the invention is shown in FIG. 1A. A stabilization pillow 100 may include a main portion 102 that may include a first main portion and a second main portion, as further described below. In many embodiments, the stabilization pillow 100 may include a top surface 104 and a bottom surface 106 having a bottom padding portion, as further described below. The stabilization pillow 100 may also include a head support portion 112 to provide lateral head support, as further described below. In some embodiments, the head support portion 112 may be recessed relative to the top surface 104. Further, the stabilization pillow 100 may include a neck support portion 108, where the neck support portion 108 may protrude relative to the top surface 104. In some embodiments, the stabilization pillow 100 may also include one or more shoulder channel(s) 112 to provide a space for the user's shoulder. For example, a user lying on their side may place the shoulder that is on the mattress in the shoulder channel 112, as further described below.

In reference to FIG. 1A, the stabilization pillow 100 may also include one or more first air channel(s) 114 that extends between the top and bottom surfaces 104, 106, as further described below. In addition, the stabilization pillow 100 may also include one or more second air channel(s) 116 that extends perpendicular to the top and bottom surfaces 104, 106. In some embodiments, the first and second air channels 114, 116 may run in any direction and may be utilized in the main portion 102, neck support portion 108, shoulder channel 112, and/or the bottom padding portion. In various embodiments, the air channels 114, 116 may be formed into the stabilization pillow 100 to allow open air channels for heat to dissipate from the user's body including, but not limited to the user's face and/or head. For example, in some embodiments, the air channels 114, 116 may be molded into a memory foam both top to bottom and side to side. In some embodiments, these air channels 114, 116 may also intersect, and/or otherwise be connected, to increase heat dissipation.

Figure 1B:
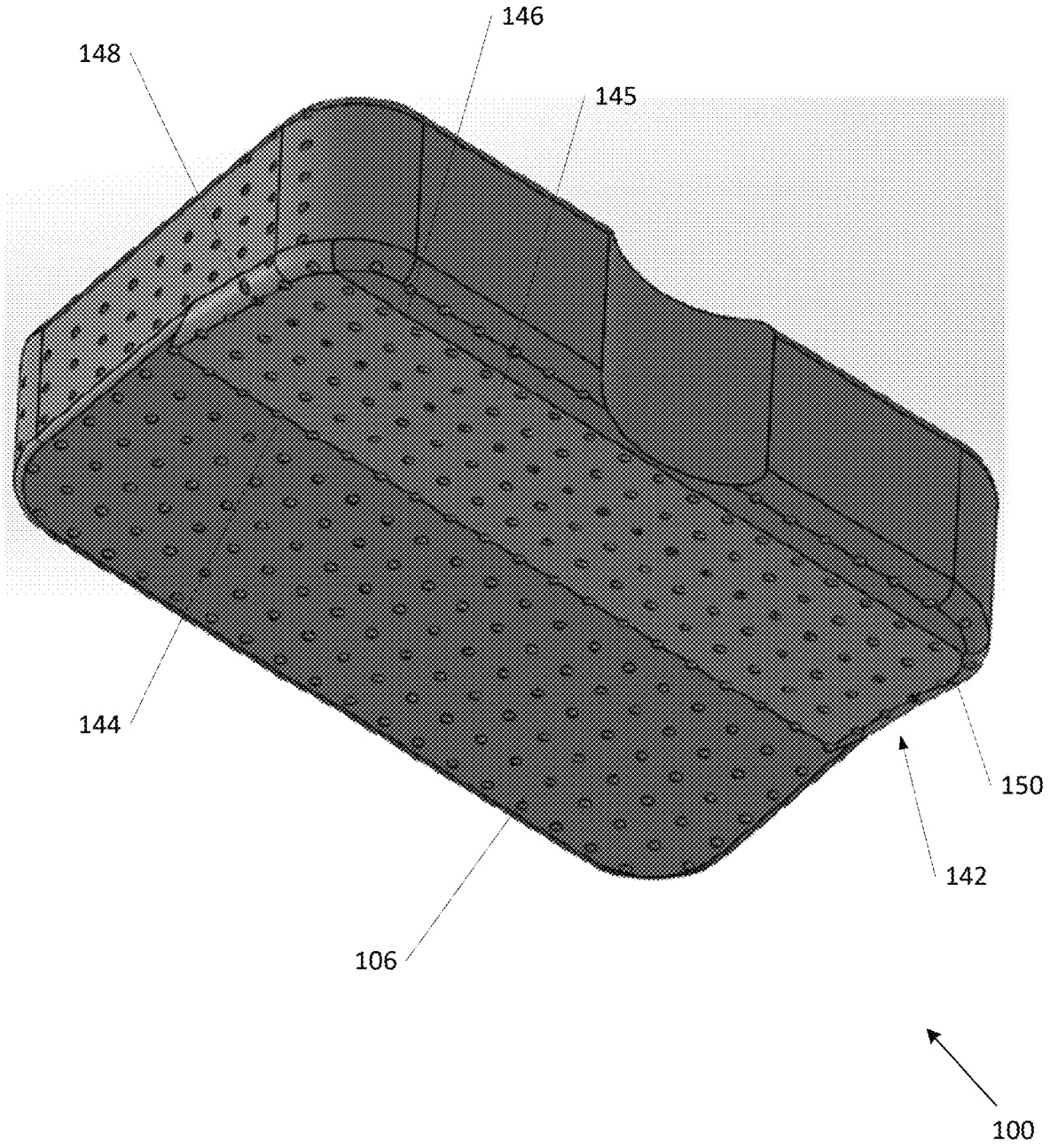
FIG. 1B is a bottom perspective view of a stabilization pillow in accordance with an embodiment of the invention.

A bottom perspective view of the stabilization pillow 100 in accordance with an embodiment of the invention is shown in FIG. 1B. As described above, the stabilization pillow 100 may include a top surface 104 and a bottom surface 106. In many embodiments, the stabilization pillow 100 may also include a bottom padding portion 142 that protrudes relative to the bottom surface 106. As further described herein, the bottom padding portion 142 may offset surface deformation caused by a user's weight on the lying surface (e.g., mattress). For example, for a user lying on a mattress, the user's weight, in particular the weight from the user's upper body (e.g., shoulder, chest, etc.) may depress the mattress thereby causing the mattress to deform. In various embodiments, the bottom padding portion 142 may offset the mattress deformation to provide proper support for the space under the user's head/neck areas and for proper support and neck/spine alignment, as further described below.

In reference to FIG. 1B, the bottom padding portion 142 may include a base 144 and a peak 146. In some embodiments, the bottom padding portion 142 may further include a declining slope 145 measured from the peak 146 to the base 144. In many embodiments, the slope 145 may be configured to a variety of degrees depending on the user and/or the mattress. One of ordinary skill would recognize that the bottom padding portion 142 may be configured for a particular individual or for a group of people based on characteristics of the users and/or the mattress. For example, for heavier users and/or softer mattresses, the declining slope 145 may be steeper and for lighter users and/or firmer mattresses, the declining slope 145 may be more gradual. In some embodiments, the bottom padding portion 142 may also include a first side 148 and a second side 150. In several embodiments, the first and second sides 148, 150 may be opposite to each other. In various embodiments, the base 144 and/or the peak 146 may extend between the first and second sides 148, 150 of the bottom padding portion 142.

Figure 1C:
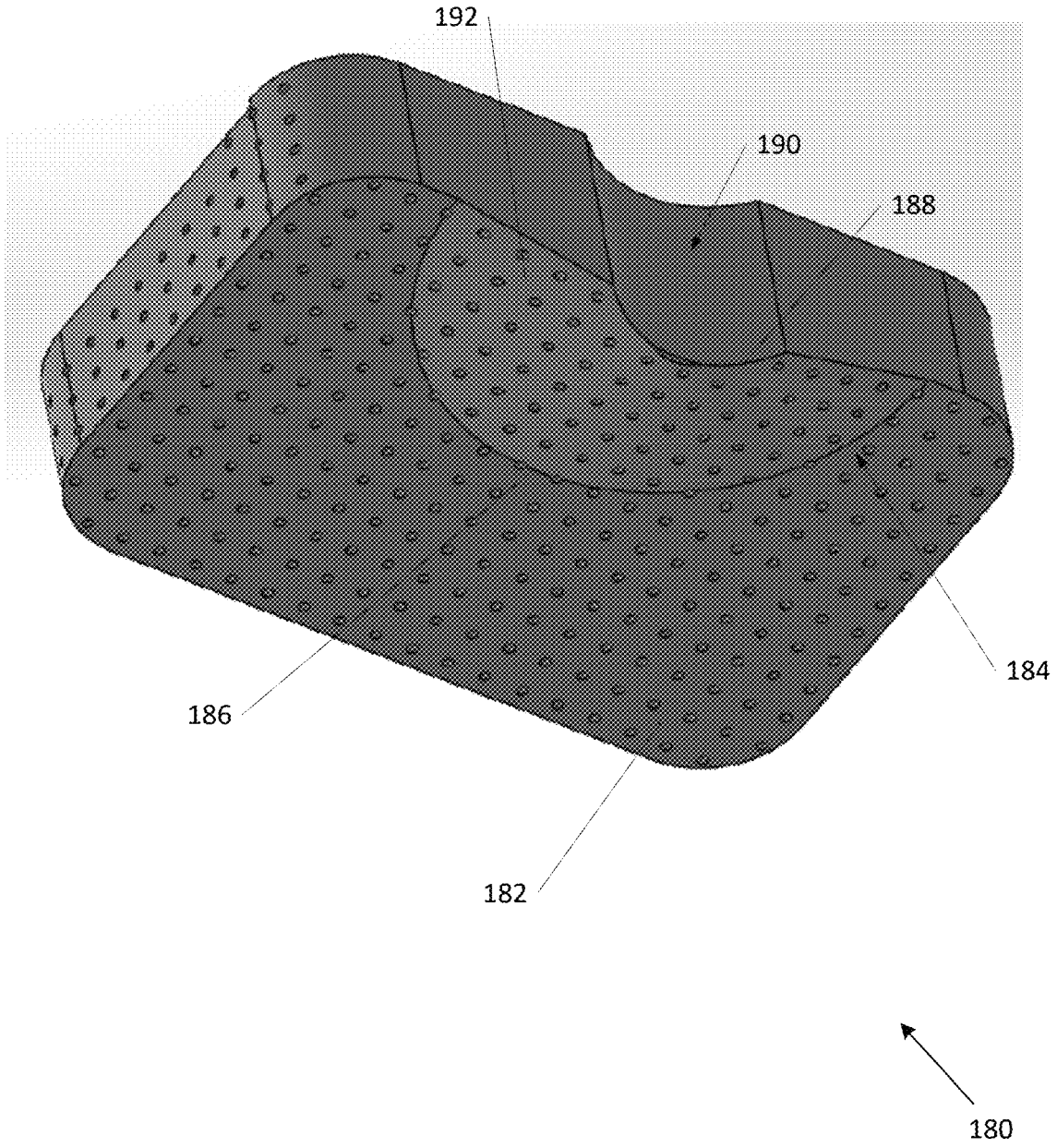
FIG. 1C is a bottom perspective view of another stabilization pillow in accordance with an embodiment of the invention.

As described above, the bottom padding portion may have a variety of shapes and sizes in offsetting mattress deformation caused by a user's weight on the mattress. A bottom perspective view of another stabilization pillow in accordance with an embodiment of the invention is shown in FIG. 1C. A stabilization pillow 180 may include a bottom padding portion 184 that protrudes relative to a bottom surface 182. In some embodiments, the bottom padding portion 184 may include a base 186 and a peak 188. In various embodiments, the base 186 and the peak 188 may rotate around a center point 190. In many embodiments, the radius from the center point 190 to the peak 188 may be less than the radius from the center point 190 to the base 186. In some embodiments, the bottom padding portion 184 may further include a declining slope 192 measured from the peak 188 to the base 186. In many embodiments, the declining slope 192 may be configured to a variety of degrees depending on the user and/or the mattress, as further described above.

In reference to FIGS. 1A-C, stabilization pillows made be constructed using variety of materials including, but not limited to, memory foam. In various embodiments, the stabilization pillows may take on any variety of shapes such as, but not limited to, a square, rectangle, cylinder, etc. For example, the stabilization pillows may include side surfaces (e.g., a first side, a second side, a third side, and a fourth side) and may be generally rectangular or square in shape. In some embodiments, the stabilization pillows may have no side surfaces and may be more circular in shape. In some embodiments, the stabilization pillows may have side surfaces (e.g., a first side surface, and a second side surface) and the center may be cylindrical in shape.

Figure 2A:
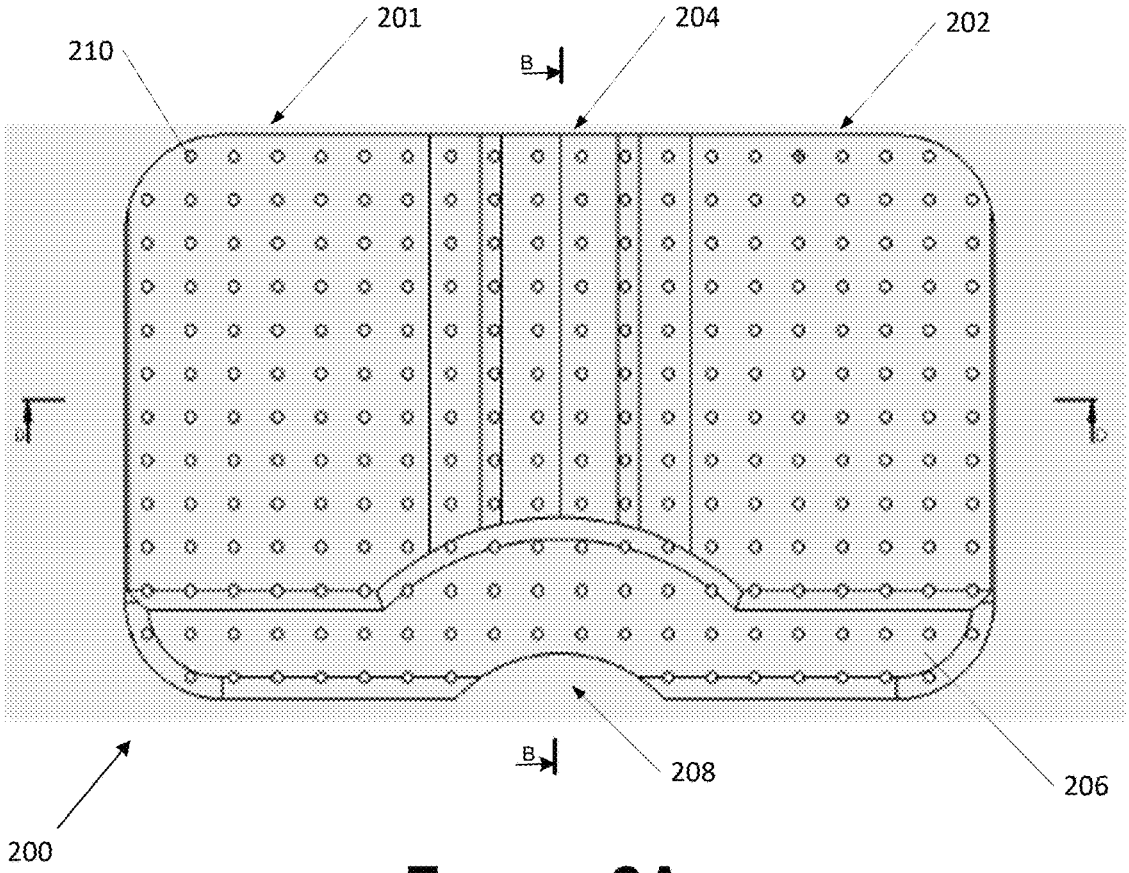
FIG. 2A is a top view of a stabilization pillow in accordance with an embodiment of the invention.

A top view of a stabilization pillow in accordance with an embodiment of the invention FIG. 2A. A stabilization pillow 200 may include a main portion that may be include a first main portion 201 and a second main portion 202. In various embodiments, the first and second main portions 201, 202 may provide support and stabilization. In many embodiments, the stabilization pillow 200 may also include a head support portion 204 to provide lateral head support, as further described below. The head support portion 204 may be positioned between the first and second main portions 201, 202. In some embodiments, the head support portion 204 may be recessed relative to the first and second main portions 201, 202. In some embodiments, the head support portion 204 may not be recessed relative to the first and second main portions 201, 202. In some embodiment, the spring constant associated with the head support portion 204 may be less than the spring constant associated with the first and/or second main portions 201, 202, thereby allowing the weight of a user's head to depress further into the stabilization pillow 200, as further described below.

In reference to FIG. 2A, the stabilization pillow 200 may also include a neck support portion 206. In many embodiments, the neck support portion 206 may be a slight raised pad for additional neck and/or lower jaw support. In various embodiments, the stabilization pillow 200 may also include a shoulder channel 208 to provide a space for the user's shoulder. The shoulder channel 208 may be a recessed area for better fitment around the user's shoulder which may be particularly useful for side sleep positions. In several embodiments, the stabilization pillow 200 may also include one or more air channels 210, as further described above. In some embodiments the air channels 210 may run vertically and/or horizontally through the stabilization pillow 200 to relieve heat and/or moisture by allowing air to flow through the stabilization pillow 200. The air channels 210 may provide a cooler pillow and may also provide a healthier pillow. For example, the air channels 210 may be more resistant to molding and/or bacteria growth and reduce allergies caused by the use of pillows.

Figure 2B:
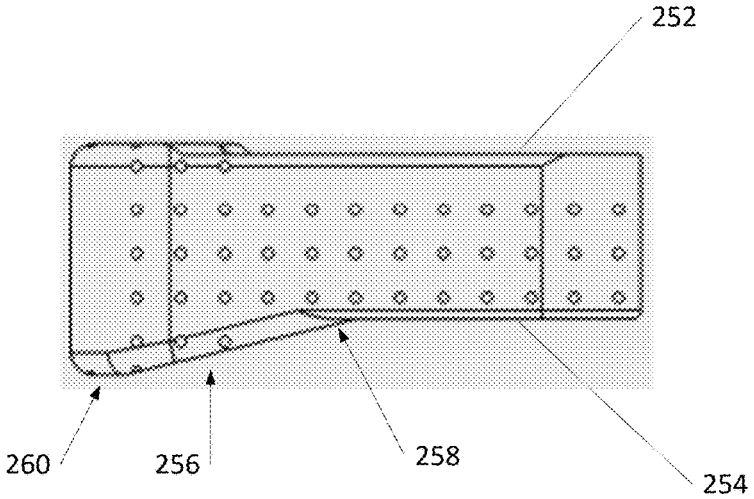
FIG. 2B is a right side view of a stabilization pillow in accordance with an embodiment of the invention.

A right side view of a stabilization pillow in accordance with an embodiment of the invention is shown in FIG. 2B. The stabilization pillow 200 may include a top surface 252 and a bottom surface 254, as further described above. In many embodiments, the top surface 252 may make contact with the user and the bottom surface 254 may make contact with the environment such as, but not limited to, a mattress. The stabilization pillow 200 may also include a bottom padding portion 256 that protrudes relative to the bottom surface 254, as further described above. In some embodiments, the bottom padding portion 256 may include a base 258 and a peak 260, as further described above.

In reference to FIG. 2B, stabilization pillows consider and account for the fact that mattresses are not flat when a user lays on them. In many embodiments, the bottom padding portion 256 may be additional padding to fill the void that is caused by the mattress from the user's body weight around the shoulders and/or upper back that recesses the mattress down. The bottom padding portion 256 helps provide proper support for the real space under the user's head for proper support and neck and/or spline alignment. The bottom padding portion 256 compensates for the compression into the mattress and/or a mattress topper created by higher pressure of the user's shoulder and/or upper body. In many embodiments, the bottom padding portion 256 may protrude the most at the peak 260 and slopes down to the base 258. As further described above, the bottom padding portion 256 may take on a variety of shapes and sizes to offset mattress deformation.

Figure 2C:
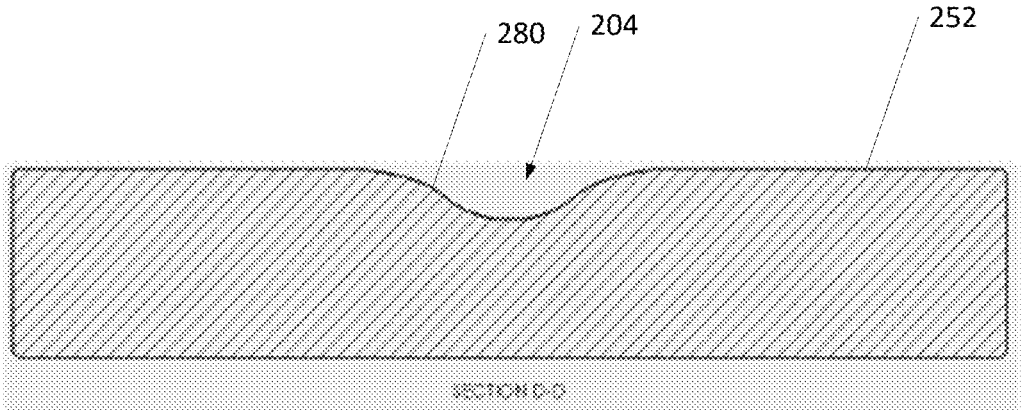
FIG. 2C is a cross sectional view along section D-D of the stabilization pillow in FIG. 2A in accordance with an embodiment of the invention.
Figure 2D:
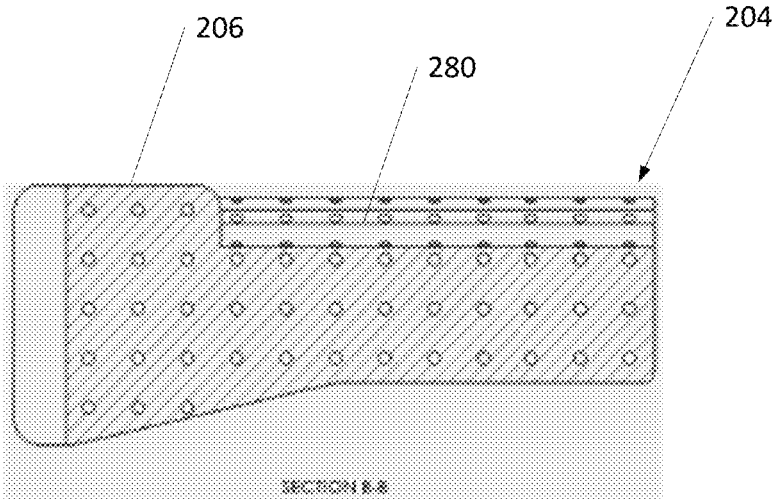
FIG. 2D is a cross sectional view along section B-B of the stabilization pillow in FIG. 2A in accordance with an embodiment of the invention.

A cross sectional view along section D-D of the stabilization pillow in FIG. 2A in accordance with an embodiment of the invention is shown in FIG. 2C. In many embodiments, the head support portion 204 may be recessed relative to the top surface 252. In some embodiments, the head support portion 204 may be recessed with a curvature 280, as further described below. A cross sectional view along section B-B of the stabilization pillow in FIG. 2A in accordance with an embodiment of the invention is shown in FIG. 2D. In some embodiments, the head support portion 204 may be recessed with a curvature 280, as further described below. In some embodiments, the head support portion 204 may also be recessed relative to the neck support portion 206. In some embodiments, the neck support portion 206 may be connected to the head support portion 204.

Although specific stabilization pillows are discussed above with respect to FIGS. 1A-2D, any of a variety of stabilization pillows including a variety of shapes, top and bottom surfaces, bottom padding portions, head support portions, neck support portions, and/or shoulder channels as appropriate to the requirements of a specific application can be utilized in accordance with embodiments of the invention. Comparisons between stabilization pillows to conventional pillows in accordance with embodiments of the invention are further described below.

Stabilization Pillows Compared to Conventional Pillows

Figure 3A:
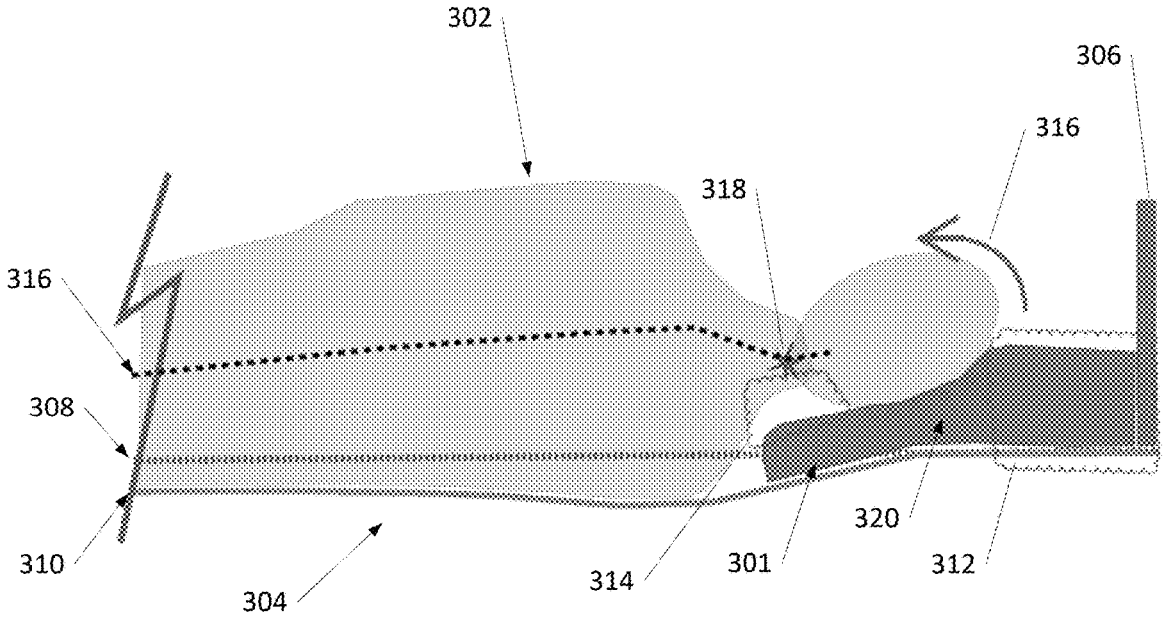
FIGURE 3A (PRIOR ART)
FIG. 3A is a diagram illustrating use of a conventional pillow in accordance with the prior art.

Stabilization pillows may alleviate pressures on a user's neck, spine, and/or head much better than conventional pillows. In particular, stabilization pillows take into account a user's physique and a user's surrounding such as, but not limited to, level of firmness of a mattress. A schematic diagram illustrating use of a convention pillow 301 in accordance with the prior art is shown in FIG. 3A. As way of example, a user 302 may lie down on a bed mattress 304. As illustrated, the bed mattress 304 (may also be referred to as a "bed" or "mattress") may be connected to a headboard 306. The mattress 304 may have a first outline 308 prior to the user 302 getting on the mattress 304 and a second outline 310 after the user is on the mattress 304. In many embodiments, the second outline 310 may be the result of the mattress 304 contoured to the user including, but not limited to, the user's size and/or weight. In various embodiments, the user's physique and/or weight on the mattress 304 creates a mattress deformation. In several embodiments, the mattress deformation may be the change from the first outline 308 to the second outline 310 of the mattress 304.

In reference to FIG. 3A, the conventional pillow 301 may deform 312 such that loose fill within the conventional pillow 301 moves around and pushes between the user's 302 head and the headboard 306. Further, the conventional pillow 301 may result in a space 314 that results in little to no support. Some sleepers naturally put their arm or hand in the space 314 to create this missing support. Moreover, the conventional pillow 301 may result in various issues such as, but not limited to, causing the lower part of the user's 302 head to sink, moment to be created 316, causing neck/spine misalignment 318. The summation of pressure vector profile 320 along the user's 302 neck and/or head longitudinally is illustrated. Typically, pressure is greater at the top than at the lower portion of the user's 302 head causing an uneven distribution of force applied. Further, with conventional pillows 301, little to no support is provided at the user's 302 neck or lower jaw, across the face, and thus the majority of reaction force 316 is towards the rear of the conventional pillow 301 causing the head to a tilt-up. Such forces may create neck and/or spine pain during side sleep with the user's 302 head equal or lower than the user's heart and tension in muscles and/or ligaments in the user's 302 neck.

Figure 3B:
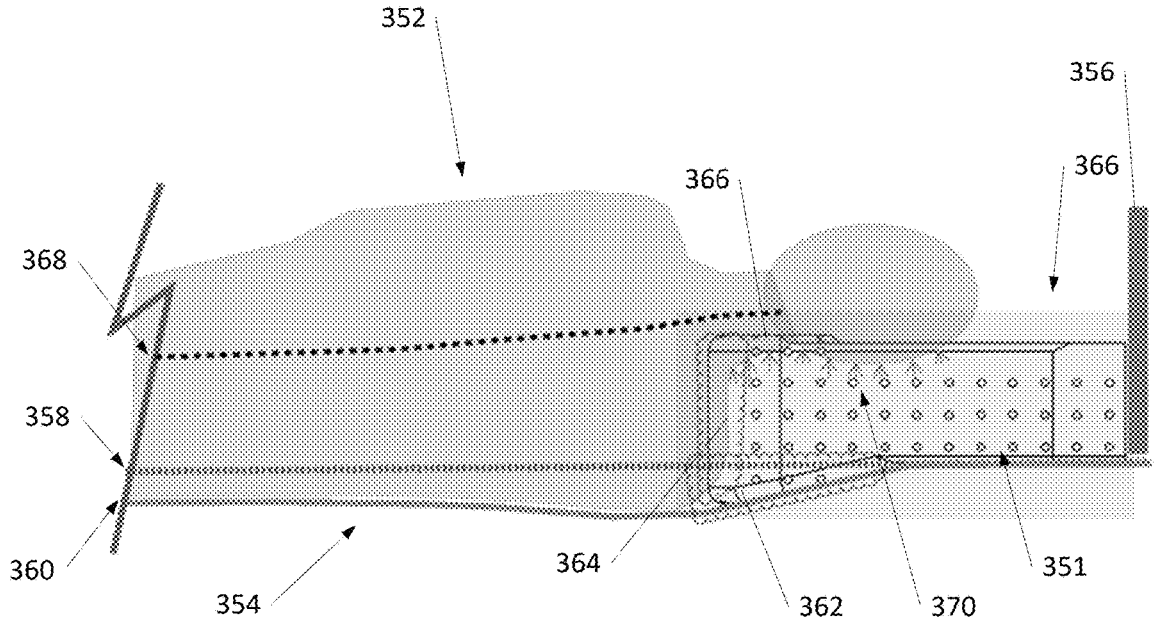
FIG. 3B is a diagram illustrating use of a stabilization pillow in accordance with an embodiment of the invention.

A diagram illustrating use of a stabilization pillow 351 in accordance with an embodiment of the invention is shown in FIG. 3B. In many embodiments, a user 352 may lie down on a mattress 354. In some embodiments, the mattress 354 may be used with a headboard 356. As described above, the mattress 354 may have a first outline 358 prior to the user 352 getting on the mattress 354 and a second outline 360 after the user is on the mattress 354 as a result of the mattress 354 contouring to the user including, but not limited to, the user's size and/or weight (may also be referred to as "mattress deformation"). In several embodiments, the mattress deformation may be the change from the first outline 358 to the second outline 360 of the mattress 354.

In reference to FIG. 3B, the stabilization pillow 351 may include a bottom padding portion 362 to fill the void in the mattress 354 caused by the user's 352 weight thereby recreating a relative flat surface for the top surface of the stabilization pillow 351. In many embodiments, the bottom padding portion 362 protrudes relative to the bottom surface of the stabilization pillow 351 to offset the mattress deformation 360 caused by the user 352 on the mattress 354. The stabilization pillow 351 may also include a shoulder channel 364 that provides a space for the user's shoulder, as further described above. In addition, the stabilization pillow 351 may include a neck support portion 366 that protrudes relative to the top surface of the stabilization pillow 351 to provide additional support, as further described above. The stabilization pillow 351 may result in spinal alignment 368 that may be optimized with the user's 352 head slightly above the user's 352 heart and support along the length of the user's 352 neck and head on the stabilization pillow 351. A summation of pressure vector profile 370 along the user's 352 neck and/or head longitudinally is illustrated. In many embodiments, pressure is evenly distributed providing optimal support, as further described below.

Figure 4A:
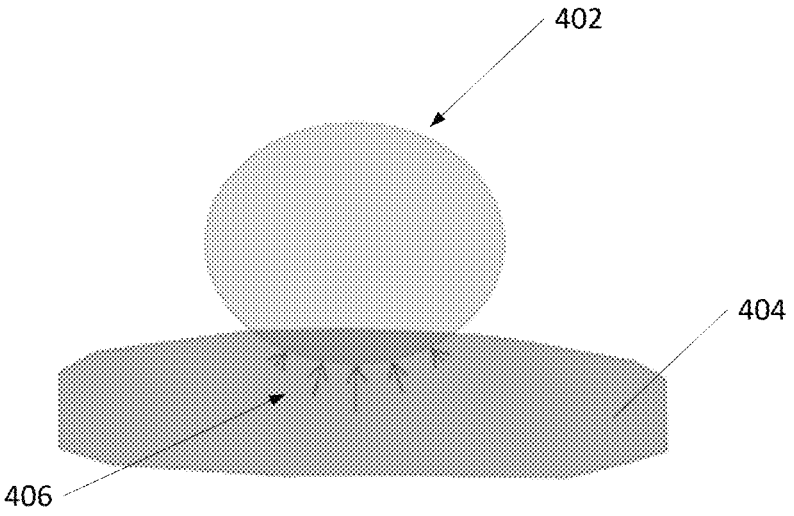
FIGURE 4A (PRIOR ART)
FIG. 4A is a diagram illustrating a force profile during use of a conventional pillow in accordance with the prior art.

A diagram illustrating a central cross section of a force profile during use of a conventional pillow in accordance with the prior art is shown in FIG. 4A. Typically, a conventional pillow 404 has most compression in the center of where the user places their head on the pillow 404 as shown in the force profile 406. The user's head 402 is supported primarily in the center of where the user places their head on the conventional pillow 404 and does not provide lateral stability. In FIG. 4A, the convention pillow 404 is shown in its un-deformed shape as way of background. In use, the convention pillow 404 would deform to the perimeter of the user's head 402.

Figure 4B:
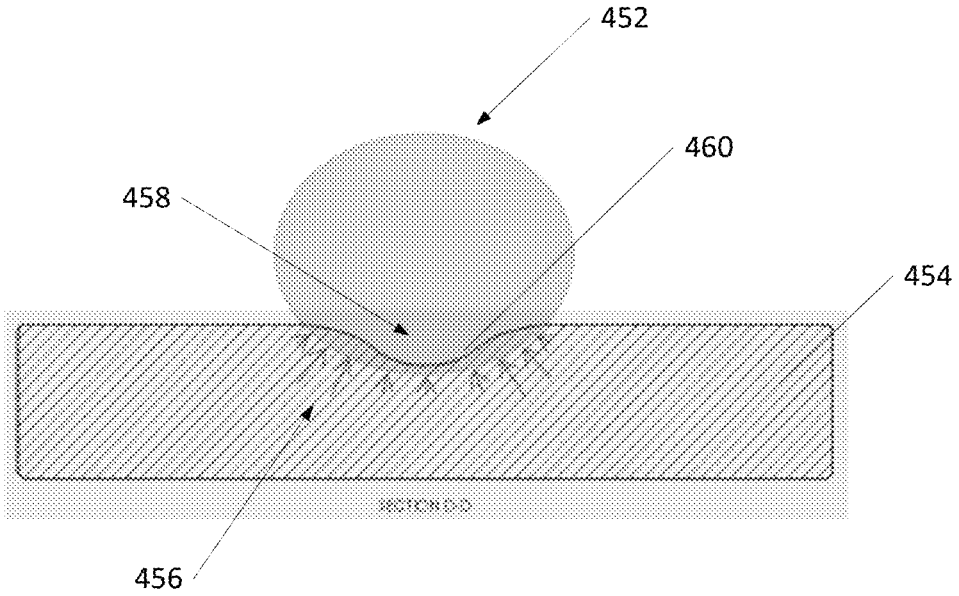
FIG. 4B is a diagram illustrating a force profile during use of a stabilization pillow in accordance with an embodiment of the invention.

A diagram illustrating a central cross section of a force profile during use of a stabilization pillow in accordance with an embodiment of the invention is shown in FIG. 4B. As described above, a stabilization pillow 454 may include a recessed contour 458. In many embodiments, the head support portion 458 may include a center section 460. In some embodiments, the center section 460 may have a contour that is sized less than a radius of a mean sized head. In some embodiments, the center section 460 may have a contour that is sized such that it is sized less than a radius of a particular user's head 452. With the user's head 452 positioned in a center of the stabilization pillow 454 and the center section contour 458 being sized less than the radius of the user's head 452, this may create larger deformations around the outer sides of the user's head 452 creating lateral stability as illustrated in the central cross section force profile 456. In many embodiments, the lateral stability may cradle and support the user's head 452 and be able to offset slight rotational imbalance of the user when at rest. In FIG. 4B, the stabilization pillow 454 is shown in an un-deformed shape as way of background. In use, the stabilization pillow 454 would deform to the perimeter of the user's head 452. In some embodiments, the force profile 456 may be generated without using a recess design but utilizing a strip of material that has a lower spring rate and thus softer to create a similar and/or same pressure profile 456 along the user's head 452.

Figure 5A:
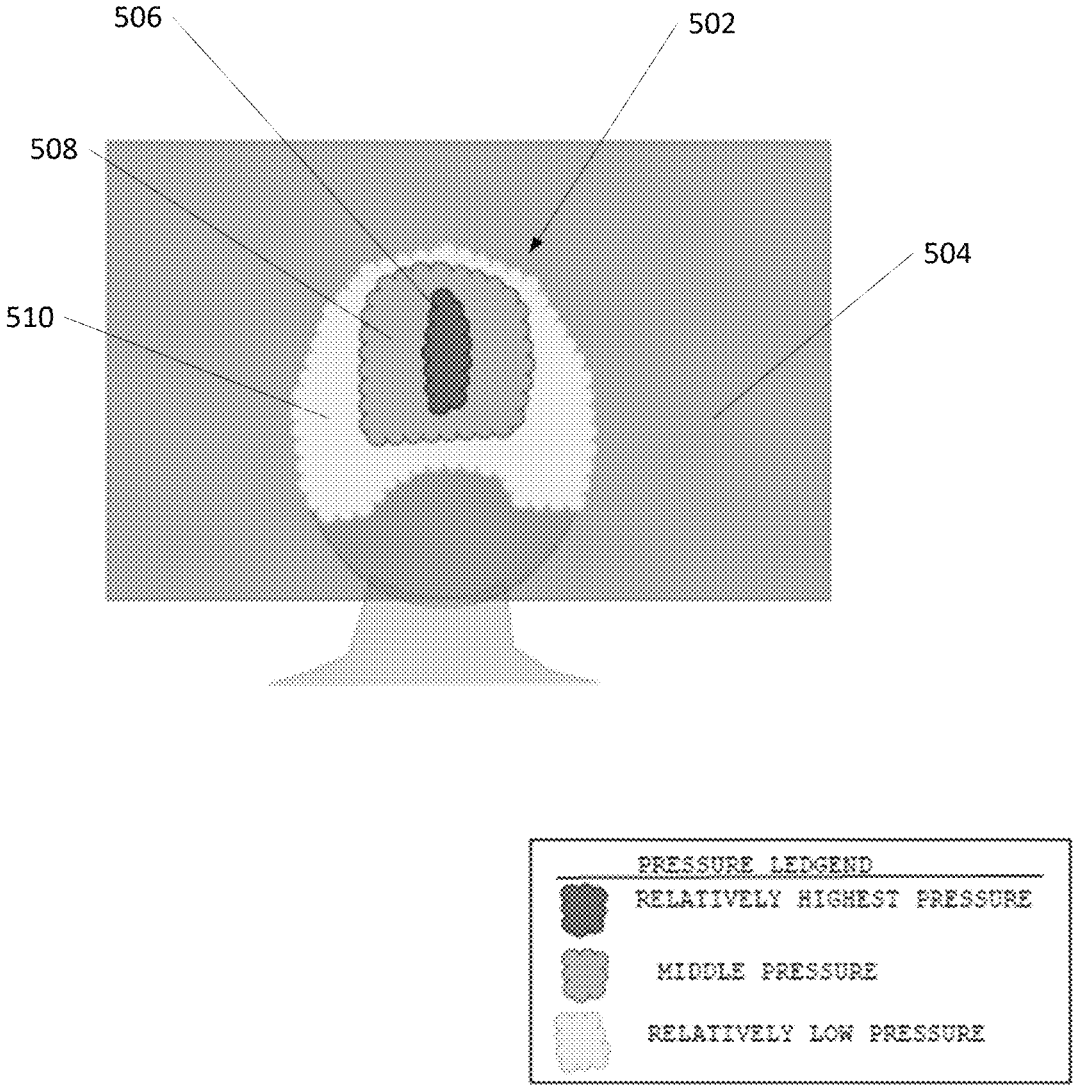
FIGURE 5A (PRIOR ART)
FIG. 5A is a diagram illustrating a pressure profile during use of a conventional pillow in accordance with the prior art.

A diagram illustrating a pressure profile during use of a conventional pillow in accordance with the prior art is shown in FIG. 5A. FIG. 5A shows a representation of the expected pressure profile created on a user's head 502 from resting on a convention pillow 504. Specifically, FIG. 5A shows an initial pressure profile on the user's head 502. At this initial stage, a relatively highest pressure 506, middle pressure 508, and low pressure 510 are illustrated.

Figure 5B:
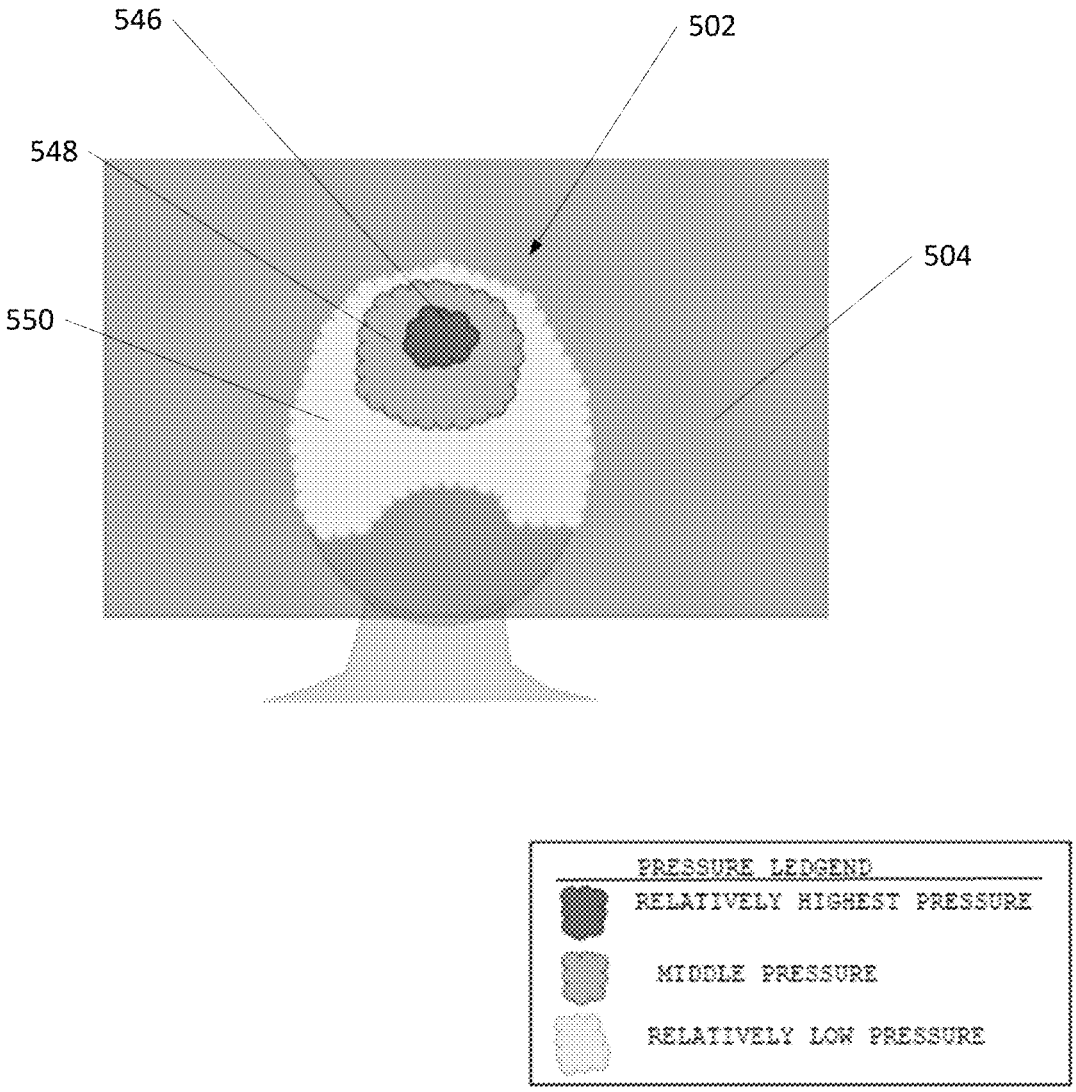
FIG. 5B is another diagram illustrating a pressure profile during use of a conventional pillow in accordance with the prior art.

Another diagram illustrating a pressure profile during use of a conventional pillow in accordance with the prior art is shown in FIG. 5B. FIG. 5B shows a representation of the expected pressure profile created on the user's head 502 from resting on a convention pillow 504. Specifically, FIG. 5B shows a profile on the user's head 502 at the end of the night after movement has transitioned and deformed the conventional pillow 504. At this stage, a relatively highest pressure 546, middle pressure 548, and low pressure 550 are illustrated.

Figure 5C:
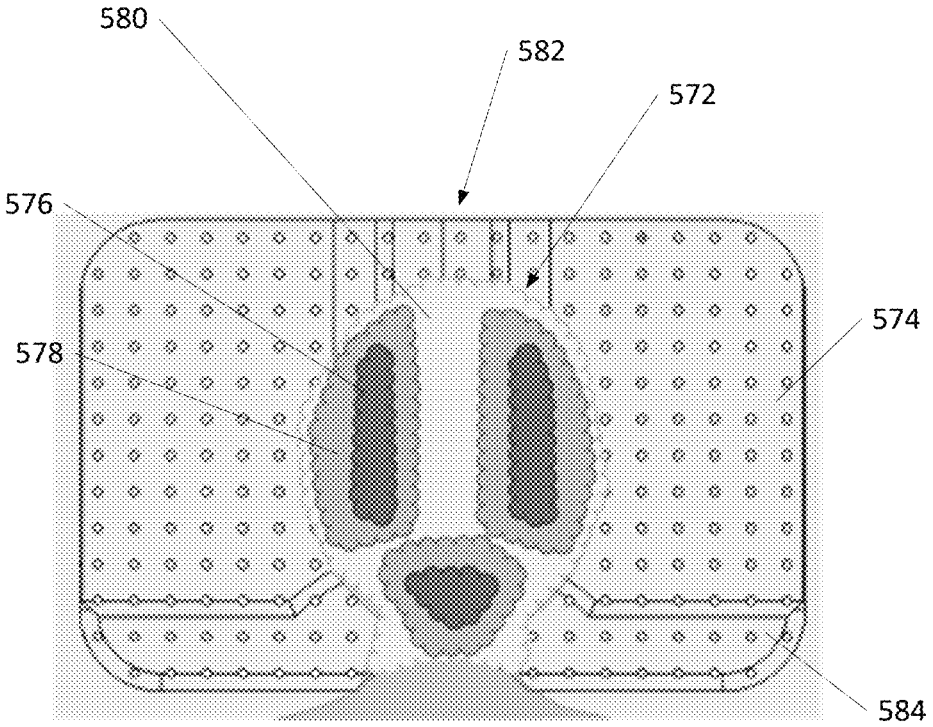
FIG. 5C is a diagram illustrating a pressure profile during use of a stabilization pillow in accordance with an embodiment of the invention.
Figure 5C:
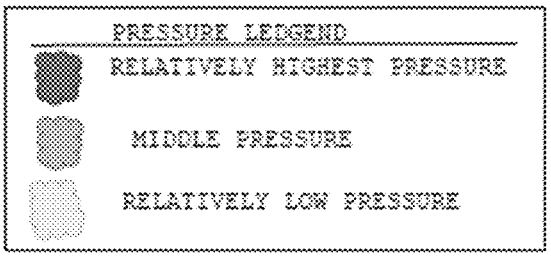

A diagram illustrating a pressure profile during use of a stabilization pillow in accordance with an embodiment of the invention is shown in FIG. 5C. FIG. 5C shows a representation of the expected pressure profile created on a user's head 572 from resting on a stabilization pillow 574. As described above, the stabilization pillow 574 may include various features such as, but not limited to, a bottom padding portion to offset mattress deformation caused by the user's weight, a head support portion 582, and a neck support portion 584. A relatively highest pressure 576, middle pressure 578, and low pressure 580 are illustrated. In contrast to the prior art, the pressure profile during use of the stabilization pillow 574, is distributed in such a specific manner as to provide lateral and longitudinal stability while also distributed to a greater portion of the user's head 572, thereby relieving pressure and alignment issues experienced by the user.

Although specific effects of stabilization pillows in contrast to conventional pillows are discussed above with respect to FIGS. 3A-5C, any of a variety of effects including pressure profiles, neck and/or spine alignments, comfort, heat control, etc. as appropriate to the requirements of a specific application may be considered in accordance with embodiments of the invention. Stabilization pillow accessories in accordance with embodiments of the invention are further described below.

Stabilization Pillow Accessories

Figure 6:
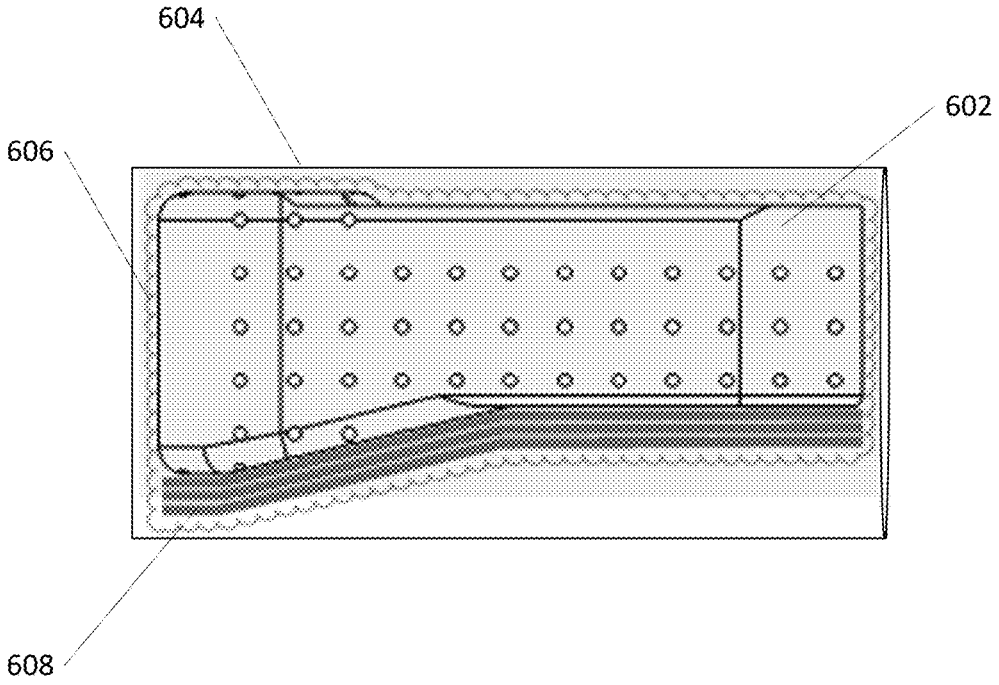
FIG. 6 is a right side view of a stabilization pillow utilizing filler panels in accordance with an embodiment of the invention.

Various accessories may be used with stabilization pillows including, but not limited to, pillow cases, inter cases, filler panels, and/or pillow pads. A right side view of a stabilization pillow utilizing a pillow case, inner case, and filler panels in accordance with an embodiment of the invention is shown in FIG. 6. In many embodiments, a stabilization pillow 602 may utilize a pillow case 604, inner cases, and/or filler panels 606. In some embodiments, the pillow case 604 may include conductive fibers (e.g., copper) for various advantages. For example, copper may be resilient and ductile enough to be woven into fabrics that are still soft to the touch. Further, copper may be a good heat conductor that may remove heat from the user's head, face, and/or neck via conduction (i.e., touch) and transfer the heat to the surrounding air via convention (i.e., transfer of heat through air). In various embodiments, the pillow case 604 may include other natural and synthetic fibers such as, but not limited to, cotton, silk, and/or synthetic fiber (e.g., Spandex, Lycra, etc.) to create a subtle, soft pillow case that is flexible and fits snugly to the stabilization pillow 602. In some embodiments, the pillow case 604 may be removed with integral zippers or other opening and fastening systems.

In reference to FIG. 6, the stabilization pillow 602 may also utilize an inter case 606 (may also be referred to as "inter cover"). In many embodiments, the inter cover 606 may be flexible enough to expand and accept one or more filler sheets 608 and additional filler sheets to provide a customizable thickness to ergonomically fit various body and mattress types and comfort preferences of the user. For example, inserting one or more filler sheets 608 may raise the stabilization pillow 602 to a user's desired thickness. In various embodiments, the filler sheets 608 may be slide into place inside the snug inter case 606 and be removed in the same manner. In various embodiments, the filler sheets may have interlocking or matching rise and fall contours such that the sheets may not slide relative to additional inserted sheets. The inter case 608 may be using a variety of materials including, but not limited to, quilted cotton, foam sheet, memory foam, etc.

Figure 7:
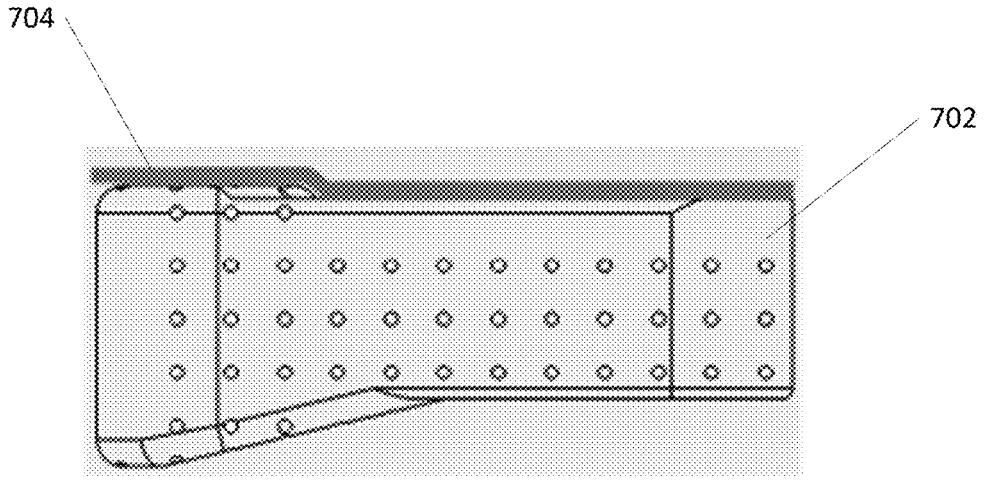
FIG. 7 is a right side view of a stabilization pillow utilizing a top layer in accordance with an embodiment of the invention.

A right side view of a stabilization pillow utilizing a top layer in accordance with an embodiment of the invention is shown in FIG. 7. The stabilization pillow 702 may utilize a top layer 704. For example, the top layer 704 may be breathable and/or soft to provide additional advantages to the user including, but not limited to, increase heat dissipation, comfort, breathability, more hygienic, etc. In some embodiments, the top layer 704 may be integrated into a pillow case or attached to the stabilization pillow 702 using a variety of methods known to one of skill in the art.

In some embodiments, silicone or other like elastomer materials may be infused, molded, or attached in some pattern to create a texture on the bottom side of an outer pillow case such to increase friction between the pillow and the mattress cover or sheet. This feature may prevent skidding of the stabilization pillow. Typically, friction may be low between a pillow/pillow case (e.g., cotton pillow case) and a bed/bed sheets. This may be further exacerbated by higher quality fine sheets, pillow cases, and pillows having much lower friction constants (e.g., high thread count and silk type materials). Thus, pillows may move around undesirably, often pushing up and away from a user's head.

Although specific stabilization pillow accessories are discussed above with respect to FIGS. 6-7, any of a variety of accessories including pillow cases, inter cases, filler panels, and/or pillow pads as appropriate to the requirements of a specific application can be utilized in accordance with embodiments of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A stabilization pillow, comprising:

a top surface and a bottom surface;

a bottom padding portion, wherein:

the bottom padding portion comprises a base and a peak;

wherein the base curves around a center point; and wherein the peak curves around the center point;

the bottom padding portion further comprises a declining slope from the peak to the base; and the bottom padding portion protrudes relative to the bottom surface to offset mattress deformation caused by a user's weight on a mattress; and a shoulder channel located at the center point, wherein the shoulder channel is a recessed area that provides space for a user's shoulder when the user is lying on their side.

2. The stabilization pillow of claim 1, wherein the stabilization pillow is constructed using memory foam.

3. The stabilization pillow of claim 1, wherein the base is located further from the center point of the fourth side than the peak.

4. The stabilization pillow of claim 1 further comprising a head support portion to provide lateral head support.

5. The stabilization pillow of claim 4, wherein the head support portion is recessed relative to the top surface.

6. The stabilization pillow of claim 4, wherein the head support portion is a channel having a center section contour.

7. The stabilization pillow of claim 6, wherein the head support portion cradles a user's head to offset rotational imbalance.

8. The stabilization pillow of claim 4, wherein a main portion of the stabilization pillow is made using a first material having a first spring constant and the head support portion is made using a second material having a second spring constant.

9. The stabilization pillow of claim 8, wherein the second spring constant is lower than the first spring constant.

10. The stabilization pillow of claim 4 further comprising a neck support portion, wherein the neck support portion protrudes relative to the top surface.

11. The stabilization pillow of claim 1 further comprising at least one first air channel that extends between the top surface through a portion of the pillow up to and including completely through the bottom surface.

12. The stabilization pillow of claim 11 further comprising at least one second air channel that extends perpendicular to the top surface and the bottom surface.

13. The stabilization pillow of claim 12, wherein the at least one first air channel and the at least one second air channel intersect.

* * * * *